US006811485B2

(12) United States Patent
Kaminkow

(10) Patent No.: US 6,811,485 B2
(45) **Date of Patent: *Nov. 2, 2004**

(54) GAMING DEVICE HAVING INCREMENTAL VALUE DISCLOSURE

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,779

(22) Filed: May 29, 2003

(65) Prior Publication Data

US 2003/0199310 A1 Oct. 23, 2003

Related U.S. Application Data

(63) Continuation of application No. 09/627,198, filed on Jul. 27, 2000, now Pat. No. 6,582,306.

(51) Int. Cl.[7] ..... A63F 9/24
(52) U.S. Cl. ..... 463/20; 463/25; 273/143 R
(58) Field of Search ..... 463/1, 16–20, 463/25, 30, 31; 273/138.1, 139, 143 R

(56) References Cited

U.S. PATENT DOCUMENTS

| | | | | |
|---|---|---|---|---|
| 4,353,554 A | | 10/1982 | Fisher | |
| 4,991,848 A | | 2/1991 | Greenwood et al. | |
| 5,116,055 A | | 5/1992 | Tracy | |
| 5,449,173 A | | 9/1995 | Thomas et al. | |
| 5,456,465 A | | 10/1995 | Durham | |
| 5,494,287 A | * | 2/1996 | Manz | 273/143 R |
| 5,524,888 A | | 6/1996 | Heidel | |
| 5,766,074 A | | 6/1998 | Cannon et al. | |
| 5,997,401 A | | 12/1999 | Crawford | |
| 6,004,207 A | | 12/1999 | Wilson, Jr. et al. | |
| 6,033,307 A | * | 3/2000 | Vancura | 463/20 |
| 6,059,289 A | | 5/2000 | Vancura | |
| 6,089,976 A | | 7/2000 | Schneider et al. | |
| 6,102,798 A | | 8/2000 | Bennett | |
| 6,142,874 A | | 11/2000 | Kodachi et al. | |
| 6,162,121 A | * | 12/2000 | Morro et al. | 463/16 |
| 6,231,445 B1 | | 5/2001 | Acres | |
| 6,315,660 B1 | | 11/2001 | DeMar et al. | |
| 6,582,306 B1 | * | 6/2003 | Kaminkow | 463/20 |

FOREIGN PATENT DOCUMENTS

| | | | | |
|---|---|---|---|---|
| EP | 0926645 A2 | | 6/1999 | |
| EP | 0944030 A2 | | 9/1999 | |
| EP | 0945837 A2 | | 9/1999 | |
| EP | 0984409 A2 | | 3/2000 | |
| WO | WO-97/30768 | * | 8/1997 | A63F/9/00 |
| WO | WO 9732285 | | 9/1997 | |

OTHER PUBLICATIONS

Winning Bid Brochure written by WMS Gaming, Inc., published prior to 2000.
Mine, Mine, Mine Brochures written by Aristocrat Leisure Industries Pty. Ltd., published in 1997.
Fortune Hunter Brochure written by Aristocrat Leisure Industries Pty. Ltd., published in 1995.
Multi Progressive Game Description written by Cherry Master, published prior to 2000.
Ben Schumin, A Salute to Game Shows–The Price is Right–Pricing Games (pp. 1–42) written by http://ben–schumin.simplnet.com/–game–shows/shows/price–is–right/pricing–games.htm, published prior to 2000.

* cited by examiner

*Primary Examiner*—Mark Sager
*Assistant Examiner*—Steven Ashburn
(74) *Attorney, Agent, or Firm*—Bell, Boyd & Lloyd, LLC

(57) ABSTRACT

A bonus scheme for a gaming device which involves the disclosure of various values to a player in increments. The player selects one or more locations, and the game discloses a value to the player. The game discloses this value partially, then pauses and then makes another partial disclosure. The game repeats this incremental disclosure until the entire value is disclosed, until a predetermined amount of time elapses or until some other predetermined event occurs. This type of bonus scheme increases player excitement and enjoyment.

100 Claims, 12 Drawing Sheets

GAMING DEVICE HAVING INCREMENTAL VALUE DISCLOSURE

PRIORITY CLAIM

This application is a continuation of, claims priority to and the benefit of U.S. patent application, Ser. No. 09/627,198, filed on Jul. 27, 2000 now U.S. Pat. No. 6,582,306, entitled "Gaming Device Having Bonus Scheme With Incremental Value Disclosure."

CROSS-REFERENCE TO RELATED APPLICATIONS

This application is related to the following commonly-owned co-pending patent applications: "GAMING DEVICE HAVING A BONUS SCHEME INCLUDING A PLURALITY OF SELECTION GROUPS WITH WIN-GROUP OUTCOMES," Ser. No 09/656,702, now U.S. Pat. No. 6,439,995; "GAMING DEVICE AND METHOD FOR ENHANCING THE ISSUANCE OR TRANSFER OF AN AWARD," Ser. No. 09/583,482, and "GAMING DEVICE HAVING REPLICATING DISPLAY THAT PROVIDES WINNING PAYLINE INFORMATION," Ser. No. 09/629,606.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which has a bonus scheme which discloses values in increments.

BACKGROUND OF THE INVENTION

In current gaming machines such as slot machines which have bonus schemes, players are able to receive various bonus values associated with various events in a bonus round. For example, a player may receive a relatively high bonus value for selecting a certain symbol and a relatively low bonus value for selecting another symbol. When these gaming devices award players with bonus values, they typically display the amount of bonus values provided to the player. For example when a player selects a symbol, the game displays the numeral fifty next to the symbol or in place of the symbol, and the game awards fifty bonus value points to the player. These existing gaming devices display the total value gained at once. They do not display the total value in increments.

To increase player enjoyment and excitement, it is desirable to provide players with gaming devices with new bonus schemes which disclose the value gained or lost by a player in increments.

SUMMARY OF THE INVENTION

The present invention overcomes the above shortcomings by providing a gaming device and method which has a bonus round which is initiated by a predetermined triggering event. A triggering event can be any event in any primary game of a gaming device which triggers a bonus round, such as reaching a predetermined combination of symbols on a set of reels.

The bonus scheme of the present invention includes at least one and preferably a plurality of locations and one or more bonus values associated with the locations. A location includes any area, symbol or selection displayed by the gaming device. The values are preferably numbers which can be positive or negative and which can vary from location to location. The value associated with each location is the total amount of value (hereafter referred to as "total value") that the game provides for any one location.

The game enables the player to select one or more of the locations. After the selection, the game displays or discloses the total values in increments. Preferably the game makes this disclosure simultaneously for all of the selected locations after the player makes all of the selections. The term "increments," as used herein, includes a plurality of partial disclosures wherein each partial disclosure is separated from the other by a time period or pause.

After disclosing a portion of the total value for each location, the game pauses the disclosure for a predetermined amount of time and then resumes disclosure. The computer carries out this incremental disclosure until the game discloses the total value for each of the selected locations, until a predetermined time period elapses or until some other predetermined event occurs. The portion of the total value disclosed in a partial disclosure, the number of increments used and the duration of the pauses are predetermined or generated by the computer of the gaming device during the bonus round.

When the game has completed the entire disclosure, the game can increase or decrease a player's balance of values by adding the total value gained (i.e., a positive value) or the total value lost (i.e., a negative value) to this balance. The game then provides the corresponding payouts to the player, and the bonus round terminates.

In one preferred embodiment of the present invention, the primary game includes a plurality of reels which include a plurality of symbols. After a player spins the reels and they stop spinning, the reels display certain symbols. If the reels display three or more predetermined, identical symbols on adjacent reels, the game initiates a bonus round.

In the bonus round, the number of locations that a player can select is equal to the number of identical symbols which triggered the bonus round. The player can make a certain number of selections equal to this number. Each time the player makes a selection, the game identifies the selected location with an indicator. The game discloses the total value for the selected locations, in increments preferably simultaneously after the player completes making all of the allowed selections. These increments of disclosure continue until the game discloses the total value for each selected location. Then the game provides the values and corresponding payout to the player. Preferably, the game also reveals or displays to the player the total values for the non-selected locations which the player would have gained had the player chosen these selections.

Furthermore in this preferred embodiment, the game displays one or more characters. Before the player makes the first selection, a character orally prompts the player to make all of the selections. Also, when the game pauses the value disclosure, a character audibly informs the player of the values accumulated by the player thus far and that further disclosure is to come.

Preferably, the game makes value disclosures by displaying a rolling value meter which starts and stops in accordance with the increments. One value meter is positioned adjacent to each location. Also, when the player selects a location, the game displays an indicator at the selected location. Here, the indicator is an oil derrick. As the game discloses values to a player, the oil derrick symbol moves, vibrates or animates in order to represent the pumping of oil.

The bonus scheme of the present invention provides an incremental manner of disclosing values to players. The game discloses the total value to the player in various portions. Each disclosure is separated by a pause. Eventually, the game awards the player with the total value. This type of bonus scheme builds up anticipation and increases a player's excitement and enjoyment.

It is therefore an object of the present invention to provide a gaming device having a bonus scheme with incremental value disclosure.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
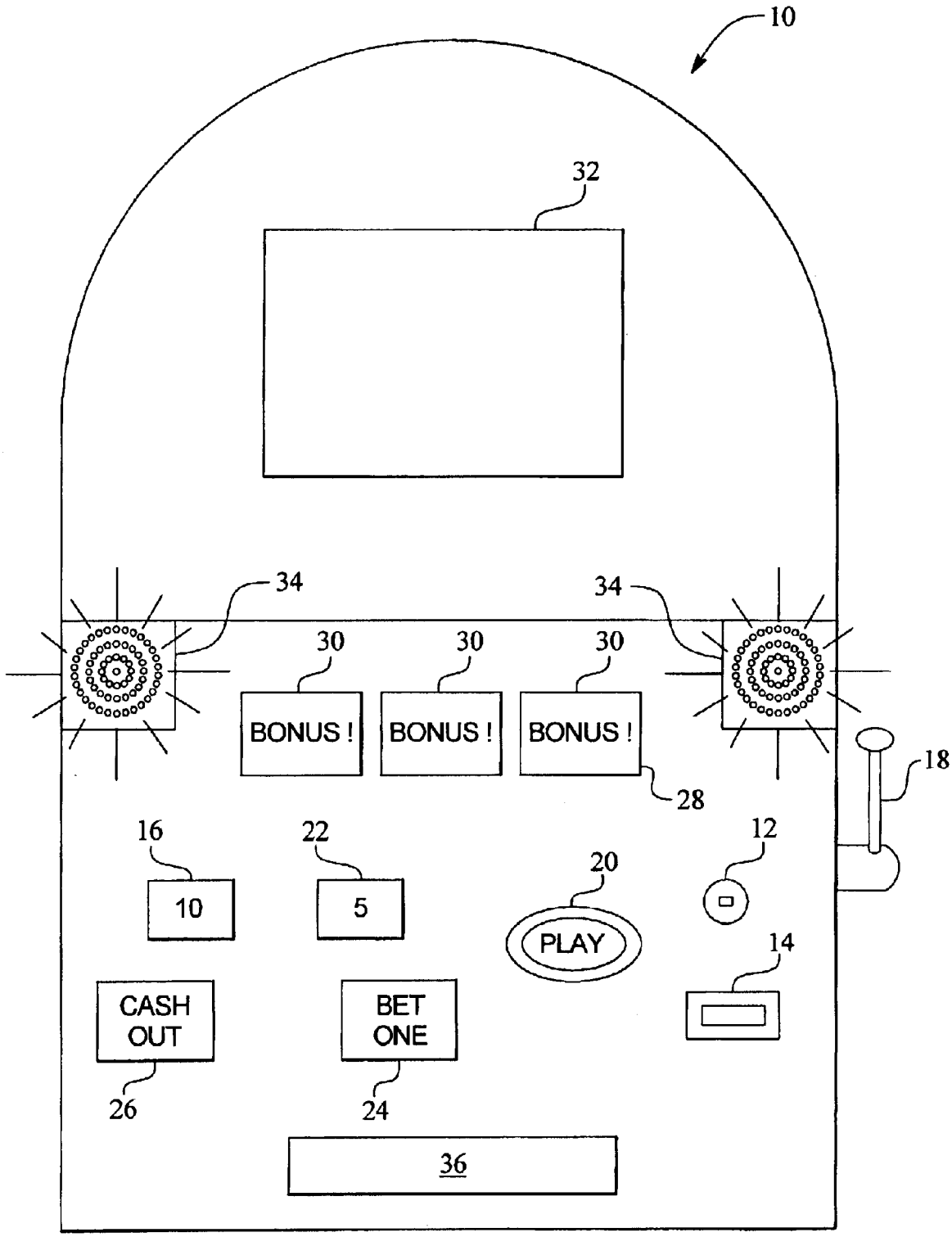
FIG. 1 is a front elevational view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device 10.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
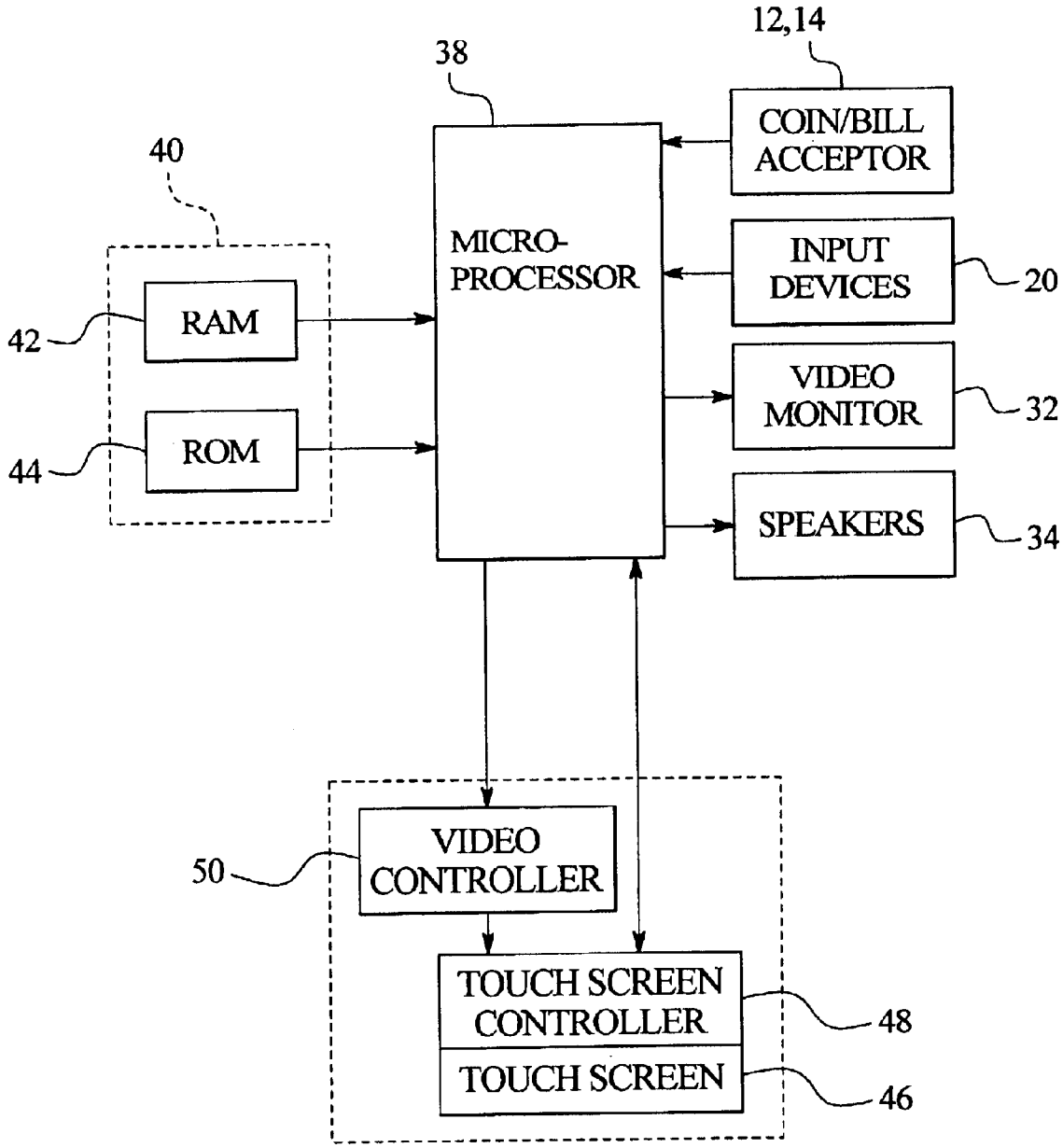
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 38, a memory device 40 for storing program code or other data, a video monitor 32 or other display device (i.e., a liquid crystal display) and at least one input device such as play buttons 20. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses play buttons 20 to input signals into gaming device 10. Furthermore, it is preferable that touch screen 46 and an associated touch screen controller 48 are used instead of a conventional video monitor 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer."

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has reached a triggering event in the game. This triggering event can be a particular arrangement of indicia on the display window 28. The gaming device 10 also includes a display device such as a video monitor 32 shown in FIG. 1 enabling the player to play the bonus round. Preferably, the triggering event is a predetermined combination of indicia appearing on a plurality of reels 30. As illustrated in the three reel slot game shown in FIG. 1, the triggering event could be the text "BONUS!" appearing in the same location on three adjacent reels.

Bonus Scheme

Figure 3:
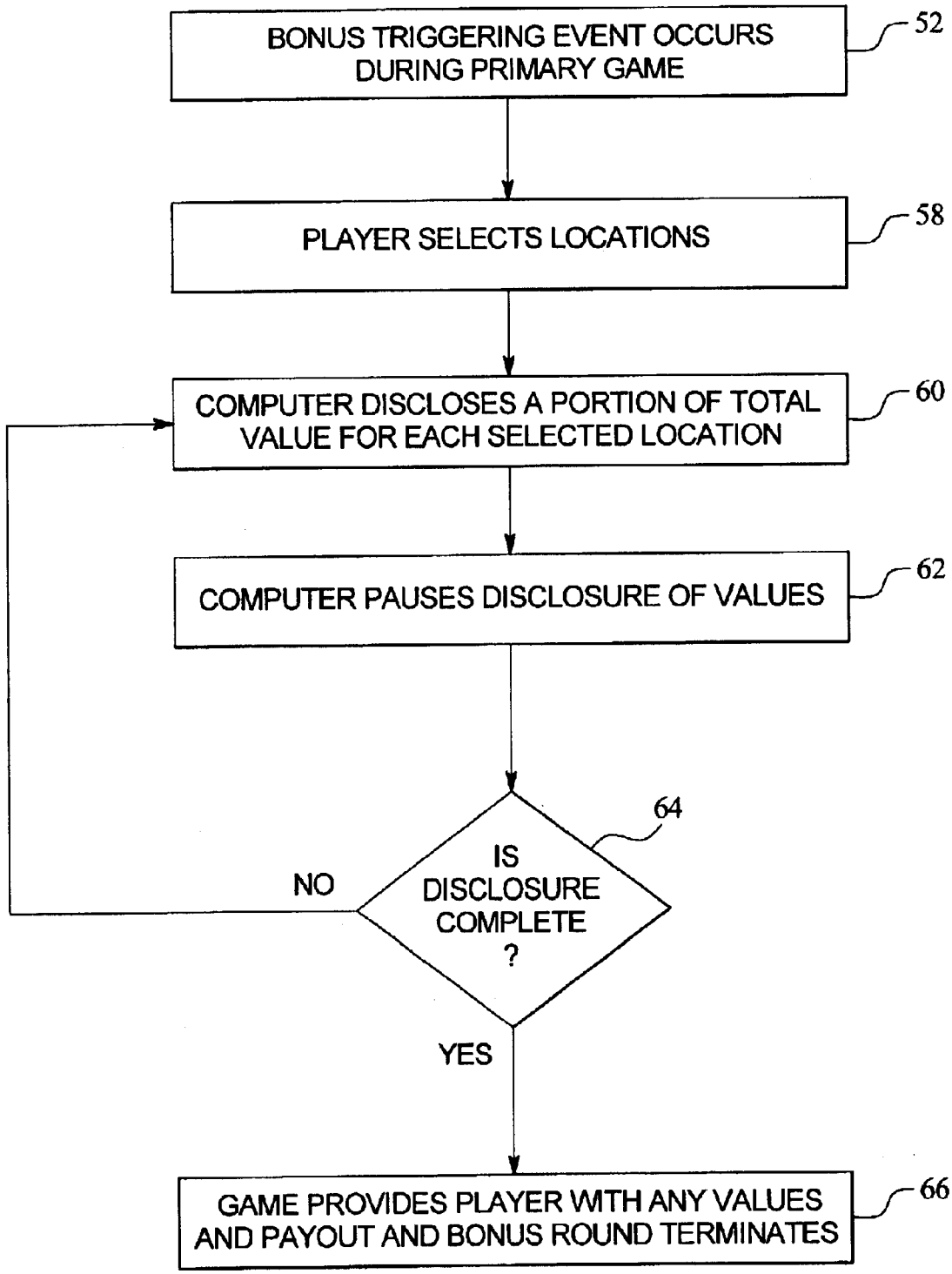
FIG. 3 is a flow diagram of one embodiment of the bonus scheme of the present invention.
Figure 4:
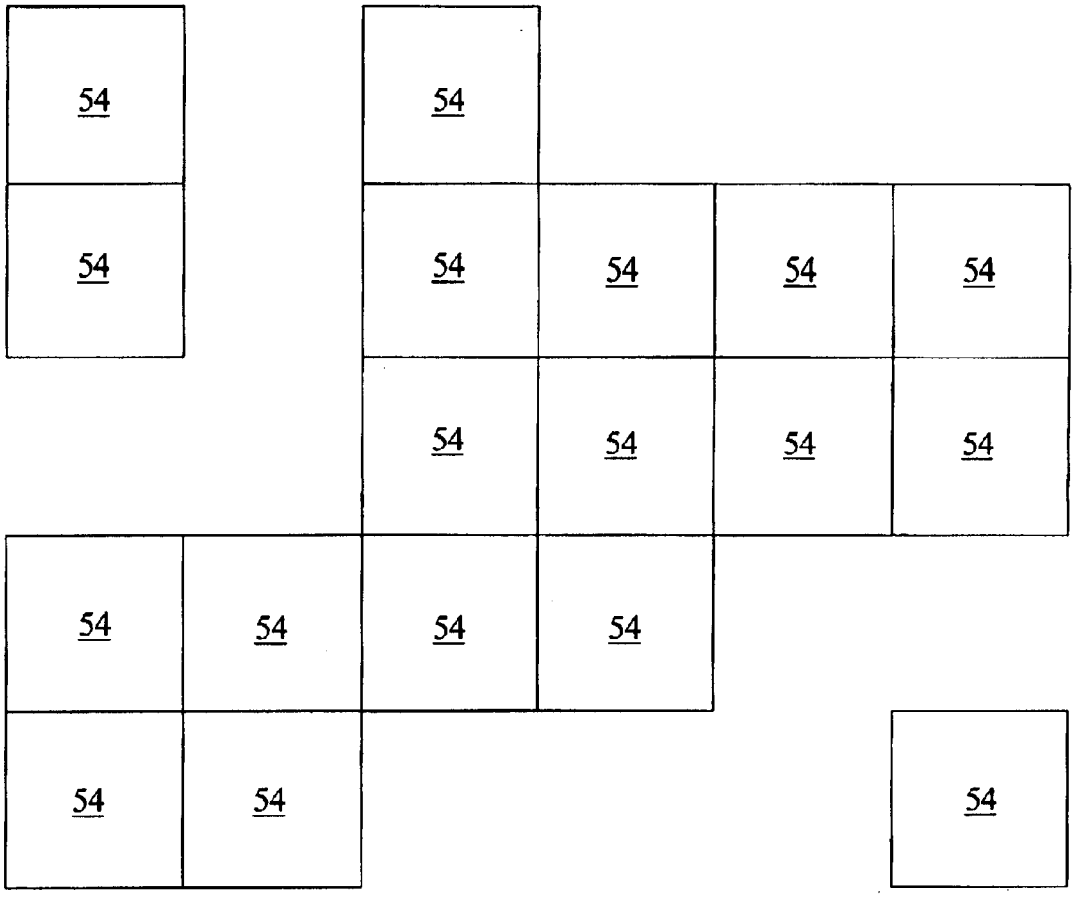
FIG. 4 is a top plan view of the locations in one embodiment of the bonus scheme of the present invention.

Referring now to FIGS. 3 and 4, the bonus round of the present invention begins when a triggering event occurs during the primary game of the gaming device 10, as indicated by block 52 in FIG. 3. Once the bonus round begins, the game enables the player to select one or more locations 54 from at least one and preferably a plurality of locations 54. A player preferably selects a location 54 by touching touch screen 46 (shown in FIG. 2) at a position adjacent to a location 54. However, a player can use play button 20 (shown in FIG. 2) or any other suitable activator to select a location 54.

Which locations 54 a player can select is either predetermined or determined by the computer during the primary game or bonus round. Locations 54 can be arranged in any orderly or disorderly fashion, connected to one another, disconnected from one another and of any size, shape or color. Locations 54 are shown in FIG. 4 as squares merely for illustrative purposes.

One or more of the locations 54 is associated with a total value. Preferably, each location 54 is associated with one total value. The total value, which can be zero or any positive or negative number such as positive fifty or negative one hundred, preferably varies from location to location; however, it should be appreciated that one or more locations 54 can have the same total value. The total value is predetermined and programmed into the computer or generated by the computer during the primary game or bonus round.

Figure 5:
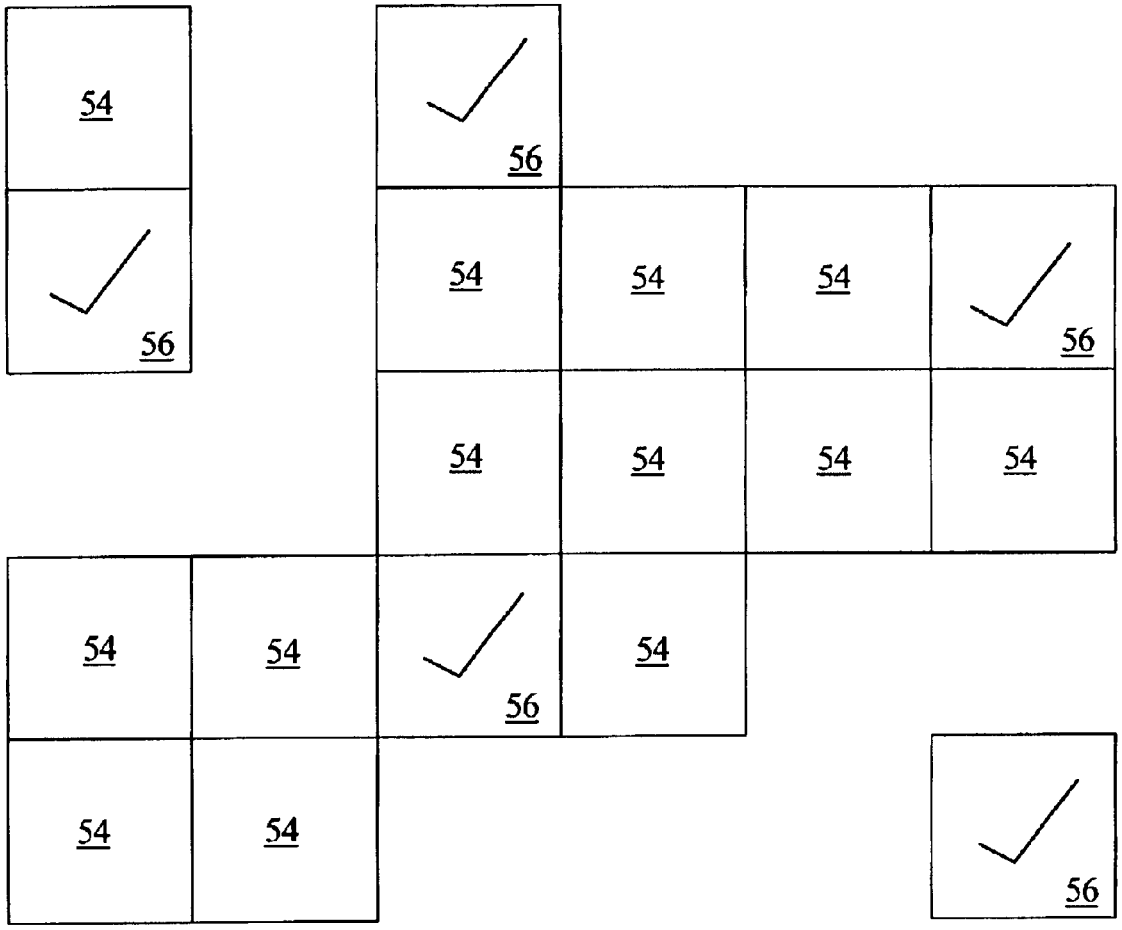
FIG. 5 is a top plan view of the locations and selected locations in one embodiment of the bonus scheme of the present invention.

In the example bonus round shown in FIGS. 4 and 5, the game enables the player to select five out of eighteen locations 54. The selected locations 56 are indicated in FIG. 5 with a checkmark, though they can be indicated in any other suitable manner. After the player makes the selections, the game discloses the total values in increments.

Referring back to FIG. 3, after the player chooses the predetermined number of selected locations 56 as indicated by block 58, the game discloses a portion of the total value associated with each selected location 56, as indicated by block 60. The game preferably conducts this disclosure simultaneously for all selected locations 56 after the player makes his or her final selection. However, the present invention can be adapted to make the disclosure for each selected location 56, individually, after the player makes his or her final selection. In this alternative, the game can complete a disclosure for each selected location 56 before conducting a disclosure on the next selected location 56, or the game can start a disclosure with one selected location 56 and before completing this disclosure start other disclosures with other selected locations 56. The game could then return to various selected locations 56 in any fashion or pattern to complete the disclosures. In another alternative, the game can make the disclosure following each selection the player makes.

In either alternative, after the game makes the disclosure the game stops or pauses any further disclosure for a predetermined, limited amount of time, as indicated by block 62. This limited amount of time is preferably in the range of one to five seconds; however, any other relatively short amount of time is suitable. Preferably, during the pause the game performs certain exhibitions, for instance including images, graphics, sounds or animations to generate anticipation, entertainment or excitement. After the pause ends, if the entire disclosure of total values for all of the selected locations 56 is complete, the computer adds the total values (whether positive or negative) to the player's existing balance of values. The game then provides the player with any payout due to the player, followed by termination of the bonus round, as indicated by diamond 64 and block 66. However, if the disclosure is not complete at this point, the game makes an additional disclosure of an additional portion of the total value for each selected location 56. The game then pauses this disclosure again, and this process repeats itself until the entire disclosure is complete, until a predetermined amount of time elapses or until some other predetermined event occurs.

Figure 6:
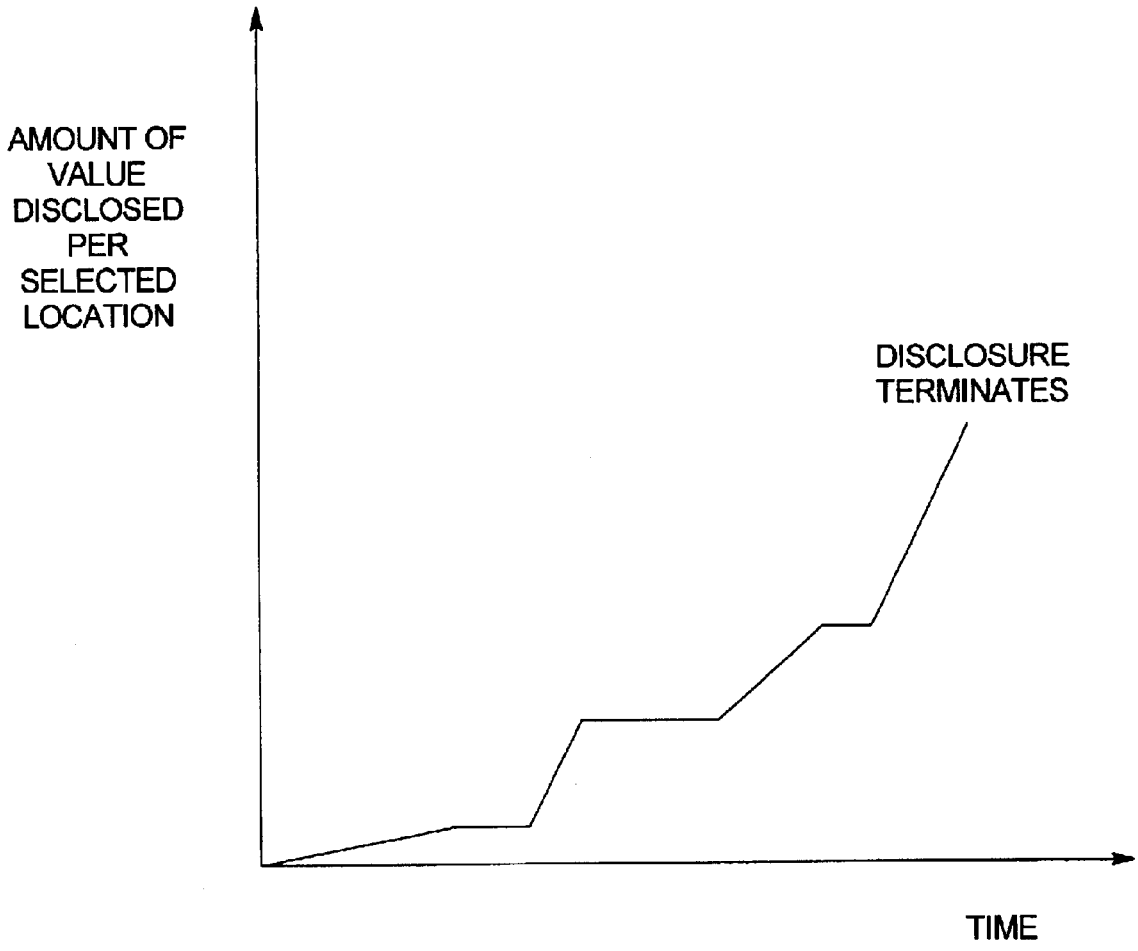
FIG. 6 is a graph diagram of the incremental value disclosure in one embodiment of the bonus scheme of the present invention.

The incremental disclosure of the present invention is generally illustrated in the graph shown in FIG. 6. The amount of the value disclosed for a single selected location 56 is plotted along the y-axis. Time is plotted along the x-axis. The curve plotted on this graph represents four separate disclosures where the game discloses a portion of the total value over a certain amount of time. The four non-horizontal lines represent the disclosures. The amount of disclosure over time can vary from partial disclosure to partial disclosure, as illustrated by the varying slopes of the non-horizontal lines in FIG. 6.

The pauses which occur in between the partial disclosures are also illustrated in FIG. 6. These pauses are illustrated as horizontal lines with varying lengths. The varying lengths of the horizontal lines illustrate that the durations of the different pauses can vary.

Figure 7:
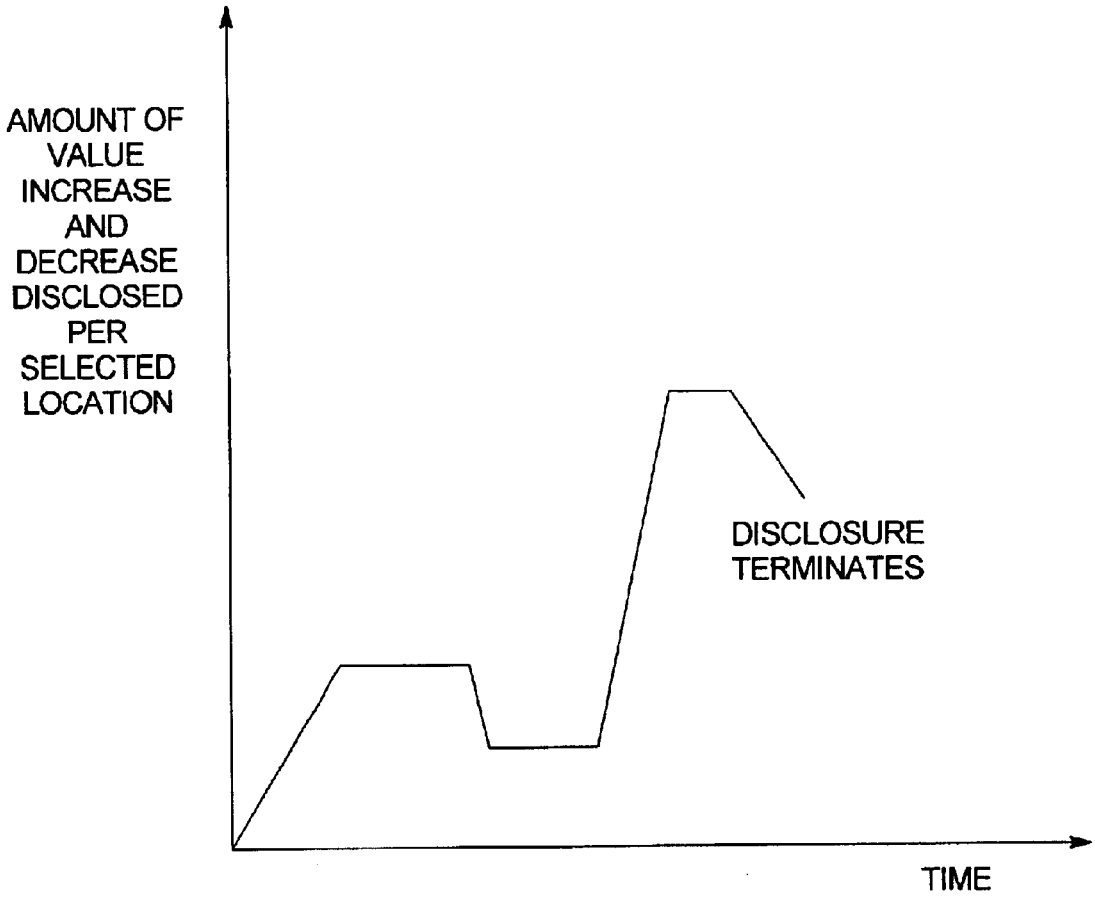
FIG. 7 is a graph diagram of the incremental value increase and decrease disclosure in one embodiment of the bonus scheme of the present invention.
Figure 8:
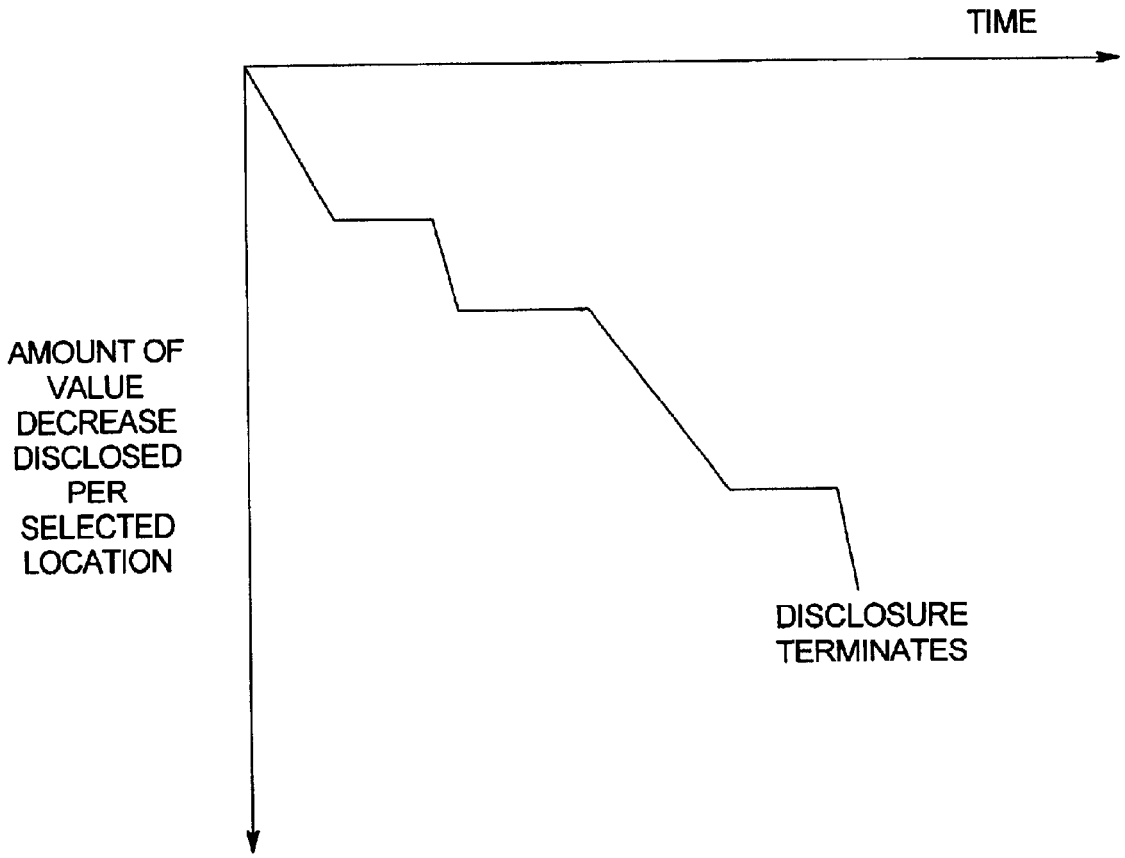
FIG. 8 is a graph diagram of the incremental value decrease disclosure in one embodiment of the bonus scheme of the present invention.

A total value for a location 56 can be negative in a variety of scenarios. For example, after the player makes the selections, the game can alternatively disclose value increases and decreases in a plurality of increments (i.e., positive one hundred in the first partial disclosure and negative one hundred and fifty in the second partial disclosure), as illustrated in FIG. 7. In another example, a player could reach a penalty screen in a bonus round where the game decreases a player's entire balance of values. Here, the game discloses only decreases in values, as illustrated in FIG. 8.

The bonus scheme of the present invention can be adapted to disclose values to players in a variety of manners. The game can display partial disclosures in a meter or other value window. For example, before the player makes the selections, the value window may display zero. After the player makes the selections and the incremental disclosure begins, the value window can display the various portions of the total value in a variety of scenarios (i.e., positive ten, then positive forty, then positive one hundred, then positive three hundred; or negative ten, then negative forty, then negative one hundred, then negative three hundred; or positive ten, then negative ten, then positive forty, then negative two hundred, then positive eighty). In all of these examples, the total value is the sum of the partial disclosures. Preferably, during the pause in between each partial disclosure, the value window displays a non-changing balance of values or sum of the partial disclosures. When disclosure resumes, the value window displays an increasing or decreasing value, in accordance with the nature of the disclosure. It should be appreciated that if a total disclosure is zero after a selection, the game can immediately display the zero value or first display various numerals and then display the zero value.

The bonus scheme of the present invention enables gaming devices to disclose values to players in increments. The game discloses a portion of a total value, followed by a pause, and this process repeats itself until the game discloses the total value. This incremental value disclosure concept effectively increases a player's anticipation, engagement and excitement when the game provides or takes away values.

Figure 9:
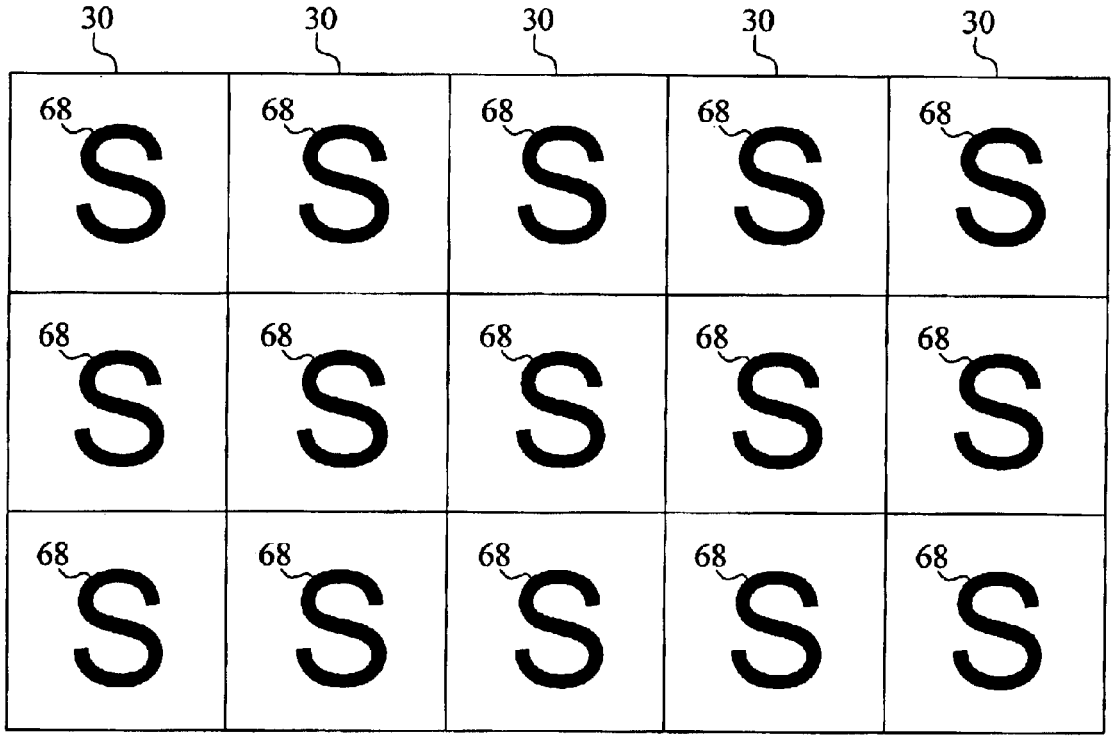
FIG. 9 is a top plan view of the reels and symbols of one embodiment of the present invention.

In one preferred embodiment of the present invention shown in FIGS. 9 through 12, the triggering event involves a plurality of reels 30 and a plurality of symbols 68 in a primary game. The symbols are indicated in FIG. 9 with an "S." The triggering event is a predetermined symbol 68 or combination of symbols 68 displayed on the reels 30. Preferably, the triggering event is three or more predetermined, identical triggering symbols 70 displayed on adjacent reels 30.

Figure 10:
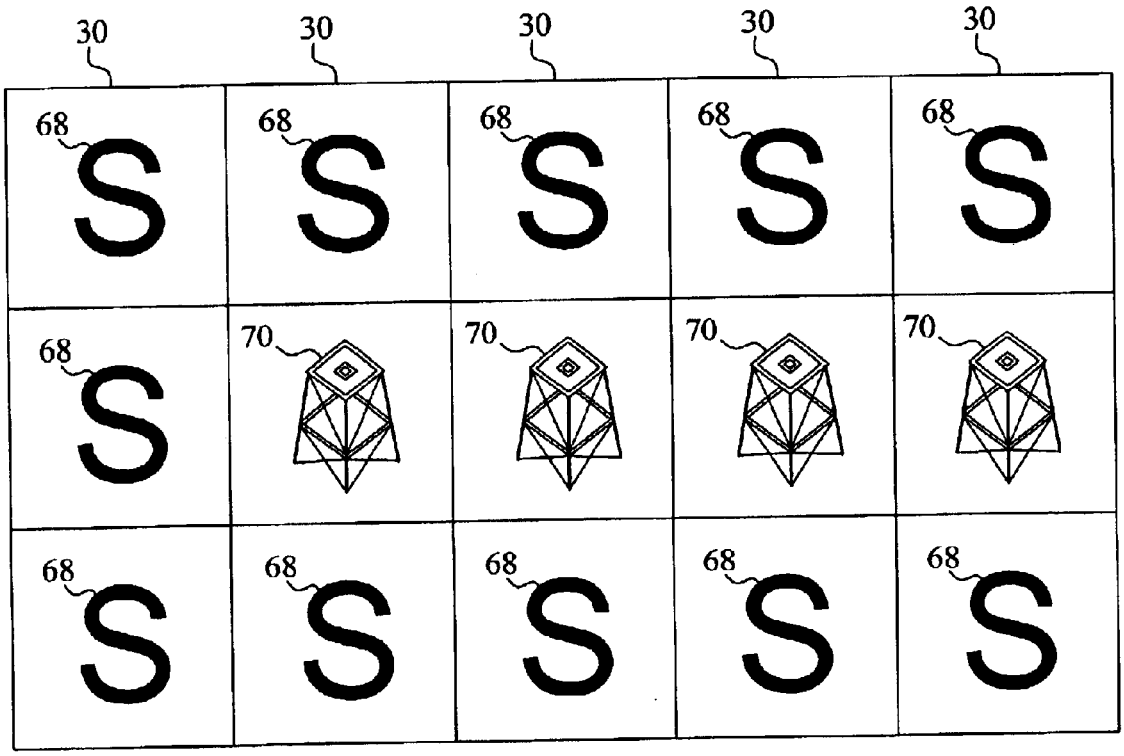
FIG. 10 is a top plan view of the reels, symbols and indicators of one embodiment of the present invention.
Figure 11:
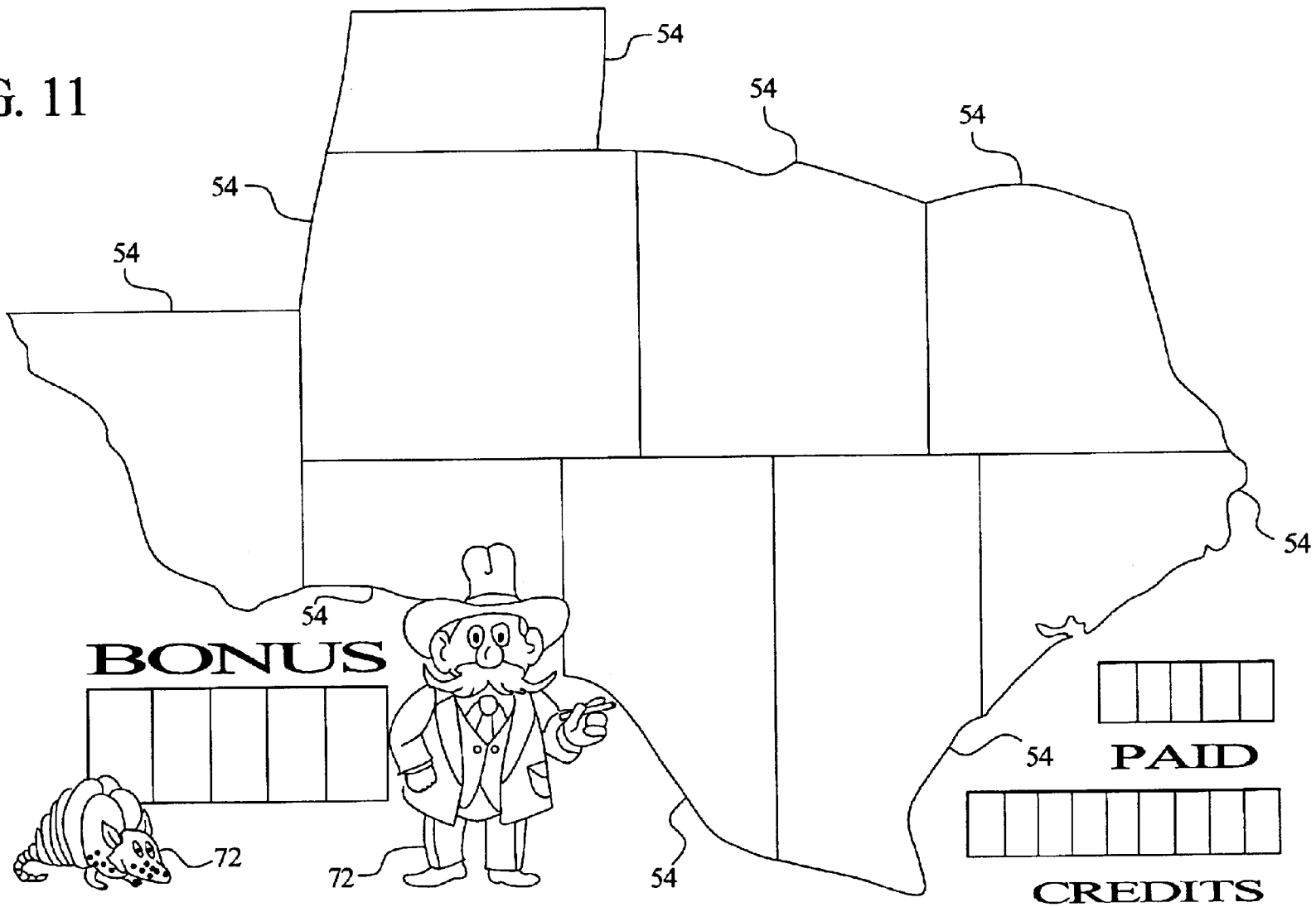
FIG. 11 is a top plan view of the locations in one embodiment of the bonus scheme of the present invention.

As shown in FIG. 10, these triggering symbols 70 are preferably oil derricks. In this example bonus round, the player reaches four adjacent triggering symbols 70, and the computer initiates the bonus round of the present invention. Next, the game displays the bonus screen shown in FIG. 11.

The first bonus screen displays a plurality of locations 54 which are connected in the shape of the state of Texas, United States. This bonus screen also includes one or more characters 72. The human character 72 informs the player that it is time for the player to make his or her selections of the locations 54.

The game then enables the player to select a certain number of locations 54. The number of triggering symbols 70 which established the triggering event equals the number of locations 54 which a player can select. In this example, the triggering event included four triggering symbols 70 (shown in FIG. 10). Therefore, the game enables the player to choose four locations 54.

Figure 12:
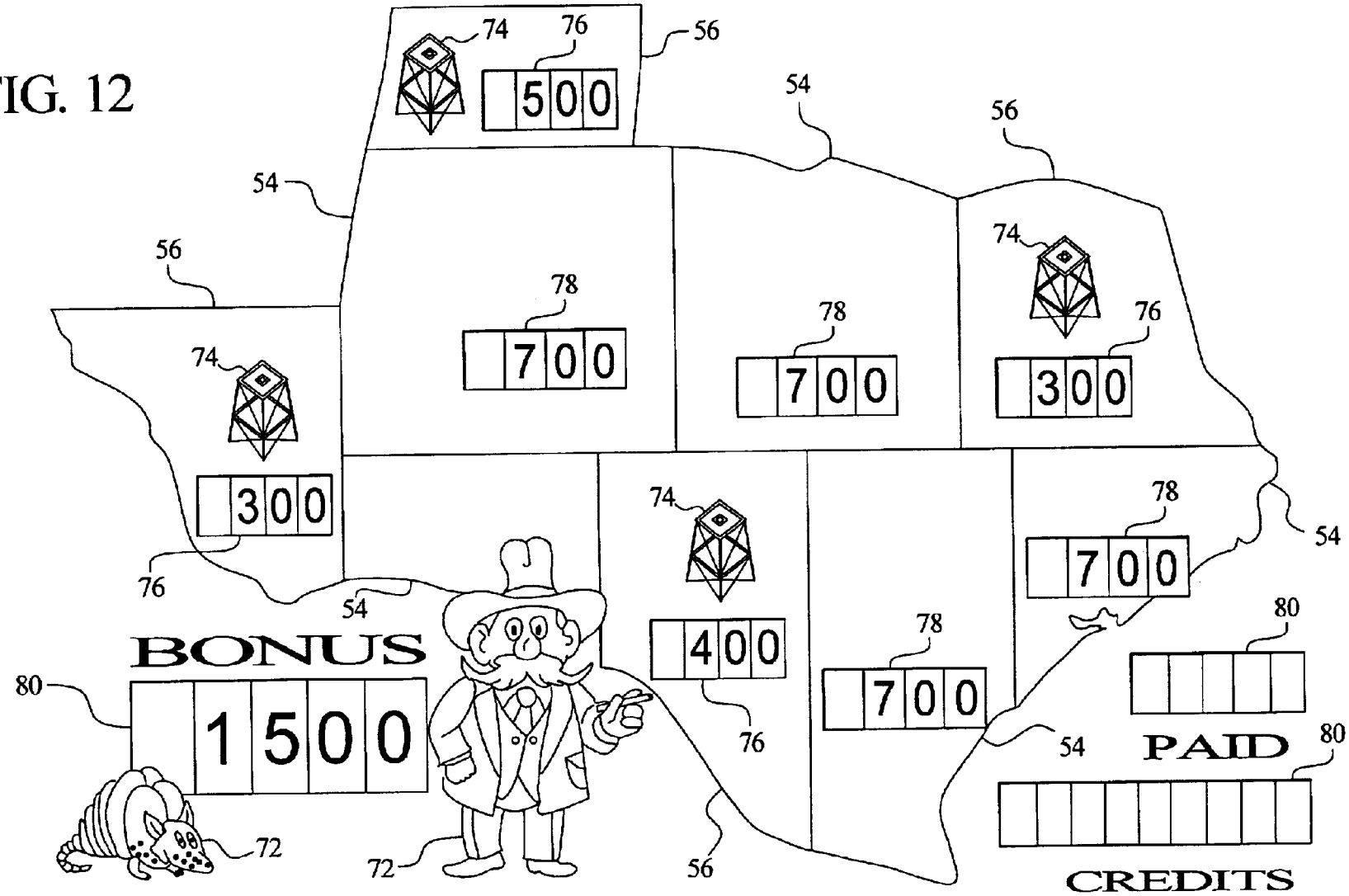
FIG. 12 is a top plan view of the locations, indicators, value meters, characters and windows in one embodiment of the bonus scheme of the present invention.

As shown in FIG. 12, when a player selects a location 54, the game displays an indicator 74 at the selected location 56. In this preferred embodiment, the indicator 74 is an oil derrick. Also, the game colors, shades or illuminates the selected locations 56 to distinguish them from the non-selected locations 54. Furthermore, one value meter 76 is displayed adjacent to each of the selected locations 56.

In this example bonus round, after receiving the prompt from the human character 72, the game enables the player to select four locations. After the player makes the four selections shown in FIG. 12, the game then discloses in increments the total value for the selected locations 56. The value meters 76 display a numeric value which gradually increases after each partial disclosure and remains unchanged during the pauses in between each partial disclosure. For example, the value meter 76 initially displays no value, and during the first partial disclosure the value meter 76 rolls the numerals one through one hundred. During the pause, the value meter 76 displays the non-changing number one hundred, and during the next partial disclosure the value meter 76 rolls the numerals one hundred through three hundred.

Also, in between each partial disclosure, a character 72 audibly informs the player of the values accumulated by the player thus far in the bonus round. The character 72 also audibly informs the player that the game will provide additional disclosure. When the disclosure in complete, the game displays one reveal meter 78 adjacent to each of the non-selected locations 54. These reveal meters 78 reveal the total value which the game would have provided to the player had the player chosen the non-selected locations 54.

In addition, when the game displays these total values, the game applies a single shade or color to the non-selected locations 54. Finally, the game animates a celebration carried out by the characters 72. This preferred embodiment also includes various windows 80 which inform the player about the player's accumulated bonus values, credits and other payout due to the player. The location 54, indicators 74, characters 72 and all other images and sounds of the present invention are related to the theme of oil business in Texas, United States.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device having a game operable upon a wager, said gaming device comprising:

a plurality of locations;

a display device operable to display the locations;

a plurality of awardable values, each of the awardable values associated with different ones of the locations, wherein, after an event occurs in the game, the display device discloses each of said awardable values by:

(a) displaying a plurality of partial disclosures of each of the awardable values in association with different ones of the locations, wherein each of the partial disclosures for each of the locations; (i) is separated from the other partial disclosure of said awardable value by a time period; and (ii) displays a value different from said awardable value; and (b) then displaying said awardable values; and an award for a player including the awardable values.

2. The gaming device of claim 1, wherein each of the awardable values is selected from the group consisting of a value of zero, a negative value and a positive value.

3. The gaming device of claim 1, wherein each of the partial disclosures for each of the awardable values is of a magnitude less than said awardable value.

4. The gaming device of claim 1, which includes an input device operable to enable a player to select the locations from a group of locations.

5. The gaming device of claim 1, wherein the display device has an electronic configuration operable to receive input through a network selected from the group consisting of a data network, a playing station network, a local area network, a wide area network and an internet.

6. The gaming device of claim 1, which includes a value meter associated with each of the locations and displayed by the display device, each of the value meters indicating the partial disclosures of the awardable value for the location associated with said value meter.

7. A gaming device having a game operable upon a wager, the gaming device comprising:

a plurality of locations;

a display device operable to display the locations;

a plurality of awardable values, each of the awardable values associated with a different one of the locations, whereby, after an event occurs in the game, the display device discloses each of the awardable values in increments ending with a display of said awardable value in association with one of the locations, wherein: (a) each of said increments includes a plurality of partial disclosures of said awardable value separated from each other by a pause; and (b) each of the partial disclosures displays a value different from said awardable value; and an award for a player including the awardable values.

8. The gaming device of claim 7, wherein each of the awardable values is selected from the group consisting of a value of zero, a negative value and a positive value.

9. The gaming device of claim 7, which includes an input device operable to enable a player to select the locations from a group of locations.

10. The gaming device of claim 7, wherein the display device has an electronic configuration operable to receive input through a network selected from the group consisting of a data network, a playing station network, a local area network, a wide area network and an internet.

11. The gaming device of claim 7, which includes a value meter associated with each of the locations and displayed by the display device, each of the value meters indicating the disclosures of the awardable values for the location associated with said value meter.

12. A gaming device having a game operable upon a wager, the gaming device comprising:

a plurality of locations;

a starting value, an intermediate value and a final value associated with different ones of the locations;

a plurality of events, each event associated with one of the locations; and a display device which, after the events associated with a plurality of the locations occur, displays: (a) each of the starting values associated with each of the locations having said associated event; (b) each of the intermediate values associated with each of said locations followed by a pause, said intermediate value resulting from a numerical change to said starting values; and (c) each of the final values associated with each of said locations; and an award for a player including the final values.

13. The gaming device of claim 12, wherein each of the starting values is selected from the group consisting of a value of zero, a negative value and a positive value.

14. The gaming device of claim 12, wherein each of the final values is greater than one of the starting values or less than one of the starting values.

15. The gaming device of claim 12, wherein the numerical change includes an increase or a decrease to one of the starting values.

16. The gaming device of claim 12, which includes an input device operable to enable a player to select the locations from a group of locations.

17. The gaming device of claim 12, wherein the display device has an electronic configuration operable to receive input through a network selected from the group consisting of a data network, a playing station network, a local area network, a wide area network and an internet.

18. The gaming device of claim 12, which includes a value meter associated with each of the locations and displayed by the display device.

19. A gaming device having a game operable upon a wager, the gaming device comprising:

a plurality of locations;

a plurality of values associated with different ones of the locations, including a starting value, an intermediate value and a final value, the final value included as part or all of an award;

a graphical display associated with each of the locations, each of the graphical displays including: (a) a display of the starting value associated with said location; (b) a display of the intermediate value associated with said location followed by a pause, said intermediate value resulting from a change to said starting value; and (c) a display of the final value associated with said location; and a display device which, following an event, displays the locations and the graphical displays.

20. The gaming device of claim 19, wherein each of the starting values is selected from the group consisting of a value of zero, a negative value and a positive value.

21. The gaming device of claim 19, wherein each of the final values is greater than one of the starting values or less than one of the starting values.

22. The gaming device of claim 19, wherein the change includes an increase or a decrease to one of the starting values.

23. The gaming device of claim 19, which includes an input device operable to enable a player to select the locations from a group of locations.

24. The gaming device of claim 19, wherein the display device has an electronic configuration operable to receive input through a network selected from the group consisting of a data network, a playing station network, a local area network, a wide area network and an internet.

25. The gaming device of claim 19, which includes a value meter associated with each of the locations and displayed by the display device.

26. A gaming device having a game operable upon a wager, the gaming device comprising:

a first symbol;

a second symbol;

at least one event associated with the first symbol and the second symbol; and a display device which, after the event occurs: (a) displays a first value in association with the first symbol for a first period of time; (b) displays a second value in association with the second symbol for a second player discernable period of time; (c) displays a third value in place of and different from the first value, in association with the first symbol after the first period of time expires; and (d) displays a fourth value in place of and different from the second value, in association with the second symbol after the second period of time expires, wherein at least one of the third value and fourth value are part of an award adapted to be provided to a player, and wherein step (c) occurs after steps (a) and (b) but begins before step (d).

27. The gaming device of claim 26, which includes a processing signal received by the display device, wherein the processing signal determines the first value, the second value, the third value and the fourth value.

28. The gaming device of claim 26, which includes a processing signal received by the display device, wherein the processing signal randomly determines the third value and the fourth value.

29. The gaming device of claim 26, which includes a third symbol and at least one fifth value which is not awardable to the player, the display device displaying said fifth value in association with the third symbol after the display device displays the third value and the fourth value.

30. The gaming device of claim 26, wherein the event includes a designated game event in the game.

31. The gaming device of claim 26, which includes a plurality of value meters displayed by the display device adjacent to the first symbol and the second symbol.

32. The gaming device of claim 26, wherein the event includes a player selection of the first and second symbols.

33. The gaming device of claim 26, wherein the event includes a player selection of a plurality of symbols including the first and second symbols.

34. The gaming device of claim 26, wherein the display device has an electronic configuration operable to receive input through a network selected from the group consisting of a data network, a playing station network, a local area network, a wide area network and an internet.

35. The gaming device of claim 26, which includes a plurality of reels of the game displayed by the display device.

36. A gaming device having a game operable upon a wager, the gaming device comprising:

a first symbol;

a second symbol;

at least one event associated with the first symbol and the second symbol; and a display device which, after the event occurs: (a) displays a first value in association with the first symbol; (b) displays a second value in association with the second symbol; (c) sequentially increases the first value, on an integer by integer basis, to a third value which is different from the first value; and (d) sequentially increases the second value, on an integer by integer basis with at least one pause between the sequential increases between integers, to a fourth value which is different from the second value, wherein at least one of the values are part of an award adapted to be provided to a player, and wherein step (d) starts before step (c) is completed.

37. The gaming device of claim 36, which includes a processing signal received by the display device, wherein the processing signal determines the first value, the second value, the third value, and the fourth value.

38. The gaming device of claim 36, which includes a processing signal received by the display device, wherein the processing signal randomly determines the third value and the fourth value.

39. The gaming device of claim 36, which includes a third symbol and at least one fifth value which is not awardable to the player, the display device displaying said fifth value in association with the third symbol after the display device displays the third value and the fourth value.

40. The gaming device of claim 36, wherein the event includes a designated game event.

41. The gaming device of claim 36, which includes a plurality of value meters displayed by the display device adjacent to the first symbol and the second symbol.

42. The gaming device of claim 36, which includes a processing signal received by the display device, wherein the processing signal causes the display device to display the third value before displaying the fourth value.

43. The gaming device of claim 36, which includes a processing signal received by the display device, wherein the processing signal causes the display device to display the third value while simultaneously displaying the fourth value.

44. The gaming device of claim 36, wherein the display device has an electronic configuration operable to receive input through a network selected from the group consisting of a data network, a playing station network, a local area network, a wide area network and an internet.

45. The gaming device of claim 36, which includes a plurality of reels of the game displayed by the display device.

46. A gaming device having a game operable upon a wager, the gaming device comprising:

a first symbol and a second symbol;

at least one event associated with the first symbol and the second symbol; and a display device which, after the event occurs: (a) indicates a first value in association with the first symbol; (b) indicates a second value in association with the second symbol; (c) indicates, on a value by value basis, a plurality of third values in association with the first symbol which are greater than the first value, each of said indications separated by a period of time followed by an indication of a final third value; (d) indicates, on a value by value basis, a plurality of fourth values in association with the second symbol which are greater than the second value, each of said indications separated by a period of time followed by an indication of a final fourth value, wherein the final third value and the final fourth value are part of an award adapted to be provided to a player, wherein step (d) starts before step (c) is completed.

47. The gaming device of claim 46, which includes at least one fifth value which is not awardable to the player, the display device indicating said fifth value in association with the first symbol or the second symbol after the display device indicates the third values and the fourth values.

48. The gaming device of claim 46, wherein the event includes a designated game event.

49. The gaming device of claim 46, wherein the display device has an electronic configuration operable to receive input through a network selected from the group consisting of a data network, a playing station network, a local area network, a wide area network and an internet.

50. A method for operating a gaming device having a game operable upon a wager, said method comprising:

(a) triggering the game;

(b) displaying a plurality of locations;

(c) providing a plurality of awardable values, each of the awardable values associated with one of the locations;

(d) enabling an event to occur;

(e) disclosing each of the awardable values in association with the locations by displaying a plurality of partial disclosures of each of the awardable values in association with each of the locations, wherein each of the partial disclosures for each location; (i) is separated from the other partial disclosure for said location by a time period; and (ii) discloses a value different from said awardable value;

(f) displaying the awardable values; and (g) providing an award including the awardable values.

51. The method of claim 50, wherein the step of disclosing each of awardable values includes the step of disclosing a plurality of different values wherein each of the different values is selected from the group consisting of a value of zero, a negative value and a positive value.

52. The method of claim 50, wherein the step of displaying a plurality of partial disclosures of each of the awardable values includes the step of displaying numbers of less magnitude than said awardable value.

53. The method of claim 50, wherein the step of enabling an event to occur includes the step of enabling a player to select the locations from a group of locations.

54. The method of claim 50, wherein the step of providing an award includes the step of providing the awardable values in addition to at least one other value.

55. The method of claim 50, which includes the step of receiving input through a network selected from the group consisting of a data network, a playing station network, a local area network, a wide area network and an internet.

56. The method for claim 50, which includes the step of displaying a value meter associated with each of the displayed locations, the value meter for each said location indicating the partial disclosures of the awardable value associated with said location to the player.

57. A method for operating a gaming device having a game operable upon a wager, said method comprising:

(a) triggering the game;

(b) displaying a plurality of locations;

(c) providing a plurality of awardable values, each of the awardable values associated with different ones of the locations;

(d) enabling an event to occur;

(e) incrementally disclosing each of the awardable values in association with the different ones of the locations wherein said disclosure for each awardable value includes: (i) a plurality of partial disclosures of said awardable value each of which includes a display of a value other than said awardable value in association with said location, wherein each of said partial disclosures is separated from each other by a pause; and (ii) a display of said awardable value in association with said location and;

(f) providing an award including the awardable values.

58. The method of claim 57, wherein the step of incrementally disclosing each of the awardable values includes the step of disclosing a plurality of different values wherein each of the different values is selected from the group consisting of a value of zero, a negative value and a positive value.

59. The method of claim 57, wherein the step of incrementally disclosing each of said awardable values includes the step of displaying numbers of less magnitude than said awardable value.

60. The method of claim 57, wherein the step of enabling an event to occur includes the step of enabling a player to select the locations from a group of locations.

61. The method of claim 57, wherein the step of providing an award to a player includes the step of providing the awardable values in addition to at least one other value.

62. The method of claim 57, which includes the step of receiving input through a network selected from the group consisting of a data network, a playing station network, a local area network, a wide area network and an internet.

63. The method of claim 57, which includes the step of displaying a value meter associated with each of the displayed locations, the value meter indicating the partial disclosures of the values for the locations to the player.

64. A method for operating a gaming device having a game operable upon a wager, said method comprising:

(a) triggering the game;

(b) displaying a plurality of locations;

(c) providing a plurality of values associated with each of the locations including a starting value, and intermediate value and a final value, the final value included as part or all of an award;

(d) enabling an event to occur;

(e) displaying each of the starting values in association with different ones of the locations;

(f) displaying the intermediate values in association with different ones of the locations, each of the intermediate values resulting from a change to one of said starting values; and (g) enabling a pause to occur after each of the intermediate values is displayed;

(h) displaying each of the final values in association with different ones of the locations; and (i) providing an award including the final values.

65. The method of claim 64, wherein the step of providing a plurality of values includes the step of providing a plurality of intermediate values wherein each of the intermediate values is selected from the group consisting of a value of zero, a negative value and a positive value.

66. The method of claim 64, wherein the step of enabling an event to occur includes the step of enabling a player to select the locations from a group of locations.

67. The method of claim 64, which includes the step of receiving input through a network selected from the group consisting of a data network, a playing station network, a local area network, a wide area network and an internet.

68. A method of operating a gaming device having a game operable upon a wager, said method comprising:

(a) triggering the game;

(b) displaying a first symbol;

(c) displaying a second symbol;

(d) providing at least one event associated with the first symbol and the second symbol;

(e) displaying a first value in association with the first symbol;

(f) displaying a second value in association with the second symbol;

(g) displaying a plurality of third values, in place of and different from the first value, in association with the first symbol, said display including a display of an intermediate third value followed by a pause followed by a display of a final third value;

(h) displaying a plurality of fourth values, in place of and different from the second value, in association with the second symbol, said display including a display of an intermediate fourth value followed by a pause followed by a final fourth value; and (i) providing an award to a player, wherein said award includes the final third value and the final fourth value, wherein step (g) occurs after steps (e) and (f) but begins before step (h).

69. The method of claim 68, wherein the steps of displaying a plurality of third values and displaying a plurality of fourth values includes the step of providing a plurality of values wherein each of the values is selected from the group consisting of a value of zero, a negative value and a positive value.

70. The method of claim 68, wherein the step of enabling an event to occur includes the step of enabling a player to select the locations from a group of locations.

71. The method of claim 68, wherein steps (f) and (g) occur at different times.

72. The method of claim 68, wherein steps (f) and (g) occur simultaneously.

73. The method of claim 68, which includes the step of receiving input through a network selected from the group consisting of a data network, a playing station network, a local area network, a wide area network and an internet.

74. A method for operating a gaming device having a game operable upon a wager, said method comprising:

(a) triggering the game;

(b) displaying a first symbol;

(c) displaying a second symbol;

(d) enabling at least one event to occur which is associated with the first symbol and the second symbol;

(e) displaying a first value in association with the first symbol;

(f) displaying a second value in association with the second symbol;

(g) displaying a sequential increase in the first value, on an integer by integer basis, to a third value which is different from the first value;

(h) displaying a sequential increase in the second value, on an integer by integer basis, to a fourth value which is different from the second value; and (i) providing an award to a player, wherein said award includes the third value and the fourth values, and wherein step (h) starts before step (g) is completed.

75. The method of claim 74, wherein the steps of displaying the first value and displaying the second value include the step of displaying a plurality of values wherein each of the values is of a value selected from the group consisting of a value of zero, a negative value and a positive value.

76. The method of claim 74, wherein the step of enabling at least one event to occur includes the step of enabling a player to select the locations from a group of locations.

77. The method of claim 74, wherein steps (g) and (h) are completed at different times.

78. The method of claim 74, wherein steps (g) and (h) are completed simultaneously.

79. The method of claim 74, which includes the step of receiving input through a network selected from the group consisting of a data network, a playing station network, a local area network, a wide area network and an internet.

80. A method for operating a gaming device having a game operable upon a wager, the method comprising:

(a) triggering the game;

(b) displaying a plurality of symbols;

(c) enabling a plurality of the symbols to be selected;

(d) displaying a value in association with each of the selected symbols;

(e) displaying a first increase or a first decrease in each of the values associated with each of the selected symbols;

(f) stopping the first increase or the first decrease for a length of time and displaying a plurality of intermediate values resulting from the first increase or the first decrease; and (g) displaying a second increase or a second decrease in each of the intermediate values;

(h) stopping the second increases or the second decreases for a length of time and displaying a plurality of final values in association with each of the symbols resulting from the second increases or the second decreases; and (i) providing an award including the final values.

81. The method of claim 80, wherein the step of enabling a plurality of the symbols to be selected includes the step of enabling a player or a processor to select the symbols from a group of symbols.

82. The method of claim 80, wherein the step of displaying the value in association with each of the selected symbols includes the step of displaying a value of zero, a negative value or a positive value.

83. The method of claim 80, wherein the steps (e) through (h) define an incremental change in a plurality of the values.

84. The method of claim 80, wherein the step of displaying a first increase or a first decrease in each of the values associated with each of the selected symbols includes the step of displaying the increase or decrease in a plurality of the values simultaneously.

85. The method of claim 80, wherein the step of displaying a first increase or a first decrease in each of the values associated with each of the selected symbols includes the step of displaying the increase or decrease in a plurality of the values at different times.

86. The method of claim 80, wherein the steps (e) through (h) define a step of displaying a plurality of numeric increases or decreases on an integer by integer basis.

87. The method of claim 80, which includes the step of receiving input through a network selected from the group consisting of a data network, a playing station network, a local area network, a wide area network and an internet.

88. The method of claim 80, which includes the step of displaying a value meter associated with each of the symbols.

89. A method for operating a gaming device having a game operable upon a wager, the method comprising:

(a) triggering the game;

(b) displaying a plurality of locations;

(c) enabling at least a first one of the locations and a second one of the locations to be selected;

(d) associating a first final value with the first location and a second final value with the second location;

(e) incrementally displaying a plurality of values in association with the first location which are different than the first final value and stopping said incremental display for a period of time;

(f) incrementally displaying a plurality of values in association with the second location which are different than the second final value and stopping said incremental display for a period of time;

(g) repeating step (e) or (f) at least one time;

(h) displaying the first final value and second final value; and (i) providing an award including the first final value and the second final value.

90. The method of claim 89, wherein steps (e) and (f) are conducted alternatively.

91. The method of claim 89, wherein steps (e) and (f) are conducted simultaneously.

92. The gaming device of claim 89, wherein the step of enabling the first one of the locations and the second one of the locations to be selected includes the step of enabling a player to select said first location and said second location from a group of locations.

93. The method of claim 89, wherein steps (e) and (f) each include the step of displaying a numerical increase.

94. The method of claim 89, which includes the step of receiving input through a network selected from the group consisting of a data network, a playing station network, a local area network, a wide area network and an internet.

95. The method of claim 89, which includes the step of displaying a value meter associated with each of the locations.

96. A method for operating a gaming device, the gaming device having a game operable upon a wager, the method comprising:

(a) triggering a game;

(b) enabling an event in the game to occur;

(c) displaying a first location and a second location;

(d) associating a final value with the first location and a final value with the second location;

(e) incrementally displaying a plurality of values in association with the first location and stopping said incremental display for a period of time;

(f) incrementally displaying a plurality of values in association with the second location and stopping said incremental display for a period of time;

(g) displaying the final value in association with the first location;

(h) displaying the final value in association with the second location; and (i) providing an award including the final value associated with the first location and the final value associated with the second location.

97. The method of claim 96, wherein steps (e) and (f) are conducted alternatively.

98. The method of claim 96, wherein steps (e) and (f) are conducted simultaneously.

99. The gaming device of claim 96, wherein the step of enabling an event in the game to occur includes the step of enabling a player to select the first location and the second location from a group of locations.

100. The method of claim 96, which includes the step of receiving input through a network selected from the group consisting of a data network, a playing station network, a local area network, a wide area network and an internet.

* * * * *